US005248268A

United States Patent [19]

Rinker

[11] Patent Number: 5,248,268

[45] Date of Patent: Sep. 28, 1993

[54] MATING ELECTRICAL SAFETY PLUG AND RECEPTACLE

[76] Inventor: Michael J. Rinker, American Embassy, Unit 25402, Prague, Apo, AE 09213, Czechoslovakia

[21] Appl. No.: 906,425

[22] Filed: Jun. 30, 1992

[51] Int. Cl.[5] ..... H01R 13/10

[52] U.S. Cl. ..... 439/682; 439/692; 439/732

[58] Field of Search ..... 439/682, 685, 732, 692, 439/106, 930, 750, 108, 683

[56] References Cited

U.S. PATENT DOCUMENTS

| | | | |
|---|---|---|---|
| 1,489,283 | 4/1924 | Smyth, Jr. et al. . | |
| 1,688,772 | 10/1928 | Alden . | |
| 2,226,148 | 12/1940 | Taylor | 439/682 |
| 2,650,963 | 9/1953 | Graveno | 439/750 |
| 2,832,941 | 4/1958 | Willis | 439/750 |
| 3,271,727 | 9/1966 | Nelson | 439/682 |
| 3,631,320 | 12/1971 | Eckert . | |
| 3,794,961 | 2/1974 | Bailey et al. | 439/750 |
| 4,392,703 | 7/1983 | Hall et al. | 439/732 |
| 4,674,807 | 6/1981 | Boteller et al. | 439/106 |
| 5,082,453 | 1/1992 | Stutz, Jr. | 439/265 |

FOREIGN PATENT DOCUMENTS

| | | | |
|---|---|---|---|
| 0039541 | 11/1928 | Denmark | 439/750 |
| 3644038 | 6/1987 | Fed. Rep. of Germany | 438/750 |
| 526733 | 2/1941 | United Kingdom . | |

*Primary Examiner*—Larry I. Schwartz
*Assistant Examiner*—Hien D. Vu
*Attorney, Agent, or Firm*—Richard C. Litman

[57] ABSTRACT

A mating electrical safety plug and receptacle. The plug includes a set of non-conductive tubular prongs, each of which shrouds a conductive element. The ends of each prong are open to receive a corresponding central post of the receptacle. The plug may include a ground prong. The receptacle is provided with a set of openings, each opening adapted to receive a corresponding prong. Each opening has a central post concentrically disposed, thus producing an annular cavity for the receipt of a tubular prong. Each central post includes a recess having a conductive element disposed therein. The receptacle may also be provided with a ground opening to accommodate a plug with a ground prong. The conductive element recessed within each central post engages with a respective conductive element shrouded by a corresponding prong. These mating conductive elements engage only when the plug is fully connected. The shrouding of the conductive element in each of the prongs essentially eliminates the risk of an individual encountering an electrical shock resulting from a partially disconnected plug. The indirect accessibility of the conductive element recessed within each central post further lessens the risk of electrical shock as a result of inserting a foreign object (other than the plug) into the receptacle.

14 Claims, 4 Drawing Sheets

MATING ELECTRICAL SAFETY PLUG AND RECEPTACLE

BACKGROUND OF THE INVENTION

1. Field of the Invention

The present invention relates to a mating electrical safety plug and receptacle and more particularly, to an electrical plug and receptacle having a configuration which reduces the risk of accidental shock.

2. Description of the Prior Art

Contemporary conventional homes are supplied with numerous electrical receptacles. Electrical codes specify receptacle location requirements, that is to say how far a receptacle should be located from an opening in a wall as well as the spaced apart relationship between receptacles. Current standards typically require a receptacle be located within six feet of both sides of a doorway, a fireplace, or even a bay window. Standards also dictate a spaced apart relationship between receptacles. This spacing is generally less than or equal to twelve feet apart. Unlike earlier built homes, outlets are no longer sparsely distributed throughout a house but are distributed in such a manner so as to permit a homeowner to supply current to an appliance from virtually any point in the home without the aid of an extension cord. With this convenient distribution of receptacles, not only are receptacles becoming more accessible to children but appliances are being relocated more often, increasing the frequency with which a plug is connected and disconnected from a receptacle. As a result, adults and children alike are exposed to greater risk of hazardous electrical shock. A common occurrence of electrical shock results from contact with the partially exposed plug prongs of a partially disconnected plug. An insulated plug prong would reduce the risk of this dangerous exposure to electricity.

U.S. Pat. No. 3,631,320 issued Dec. 28, 1971 to William F. Eckert discloses a conventional type two prong plug having accordion-like insulated prong sleeves which contract and expand when the plug is connected and disconnected, respectively. This shields the plug prongs and thus, reduces the risk of accidental shock when the plug is partially withdrawn from the receptacle. This sleeve, however, is fabricated of a pliable material which is expansible and collapsible and is, therefore, substantially susceptible to splitting or cracking over a prolonged period of use, thus may eventually allow current to leak through.

U.S. Pat. No. 4,674,807 issued Jun. 23, 1987 to William C. Boteler et al. describes an electrical non-conductive outer housing and connector members recessed in one end of the housing. A male plug of this type would require a mating connector having a generally cylindrical non-conductive body. A mating connector of this type would protrude from a wall plate to a significant extent, unlike conventional receptacles which are substantially flush with a wall plate. The protrusion of a receptacle of this variety may be considered excessive and unsightly. Moreover, there exists no measure to prevent a foreign object (other than the mating plug) from being inserted into the receptacle and from engaging with the conductive elements within the receptacle, thus offering exposure to electrical shock.

A plug having a set of prongs fabricated of an non-conductive material, each prong facilitating as a shroud to conceal a conductive element, and a mating receptacle being configured so as to reduce the accessibility of the conductive elements by foreign objects (other than the mating plug) would reduce the risk of electrical shock.

None of the above inventions and patents, taken either singly or in combination, is seen to describe the instant invention as claimed.

SUMMARY OF THE INVENTION

The present invention relates to a mating electrical safety plug and receptacle. The plug includes a set of non-conductive tubular prongs, each of which shrouds a conductive element. The ends of the prongs are open to receive a central post of the receptacle. The plug may include a ground prong. The ground prong is comprised of an non-conductive tubular member having an end enclosed by an electrically conductive tip. The receptacle is provided with a set of openings, each opening adapted to receive a corresponding prong. Each opening is provided with an aforementioned central post which is concentrically disposed therein to produce an annular cavity to receive a tubular prong. Each central post includes a recess having a conductive element disposed therein. The receptacle may be provided with a ground opening which does not have a central post disposed therein. This ground opening is provided for the receipt of the ground prong. A conductive element is disposed within the ground opening which make contact with the conductive tip of the ground prong when the plug is connected to the receptacle. Moreover, when the plug is connected to the receptacle, the conductive element recessed within each central post engages with a respective conductive element shrouded by a corresponding prong. These mating conductive elements engage only when the plug is fully connected. The shrouding of the conductive element in each of the prongs essentially eliminates the risk of an individual encountering an electrical shock even when the plug is partially connected or disconnected from the receptacle. The unique configuration of the receptacle, that is, the indirect accessibility of the conductive element recessed within each central post reduces the risk of electrical shock as a result of inserting a foreign object (other than the plug) into the receptacle.

Accordingly, it is a principal object of the invention to provide a mating electrical safety plug and receptacle which reduces the risk of hazardous electrical shock.

It is another object of the invention to provide a plug which has a set of prongs, each prong being fabricated of an nonconductive material which facilitates as an insulating shroud to conceal a conductive element.

It is another object of the invention to provide a plug which is adaptable for use on virtually any appliance.

It is another object of the invention to provide a plug which is may be employed in either single phase or multi-phase applications.

It is another object of the invention to provide a receptacle having a configuration which does not permit foreign objects (other than the mating plug) to have immediate access to the conductive elements disposed therein.

It is another object of the invention to provide a mating electrical plug and receptacle which employs a unique conductor coupling configuration which substantially eliminates the risk of electrical shock occurring f rom a partially connected or disconnected plug.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
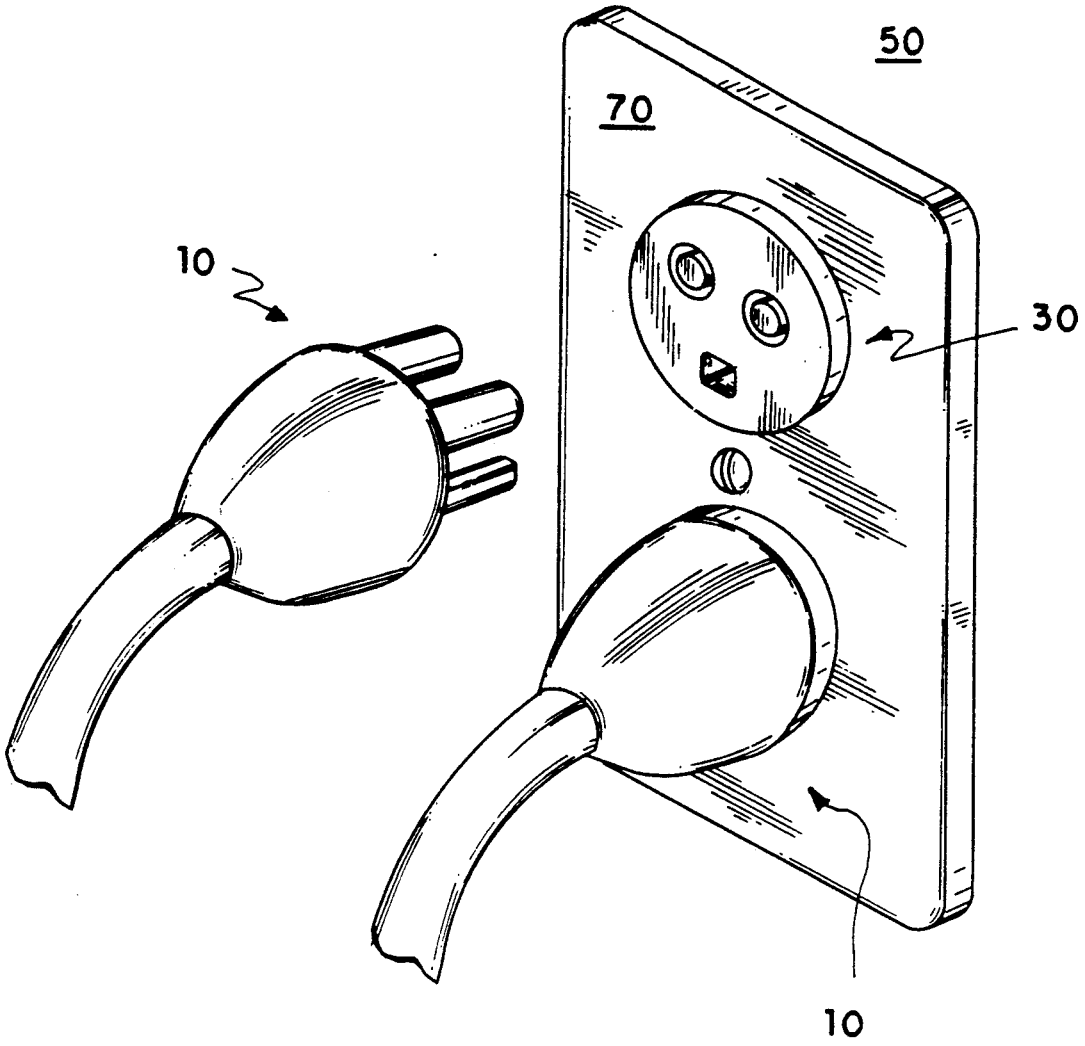
FIG. 1 is an environmental perspective view of the mating electrical safety plug and receptacle.
Figure 2:
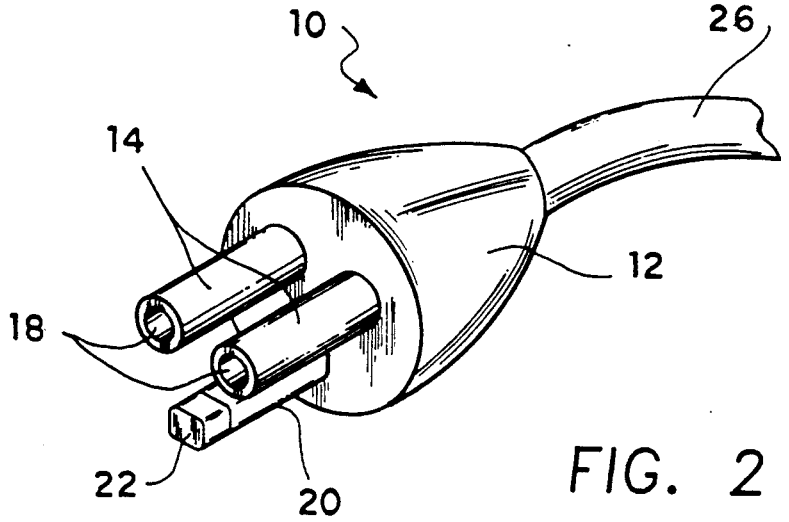
FIG. 2 is a perspective view of the electrical plug.
Figure 3:
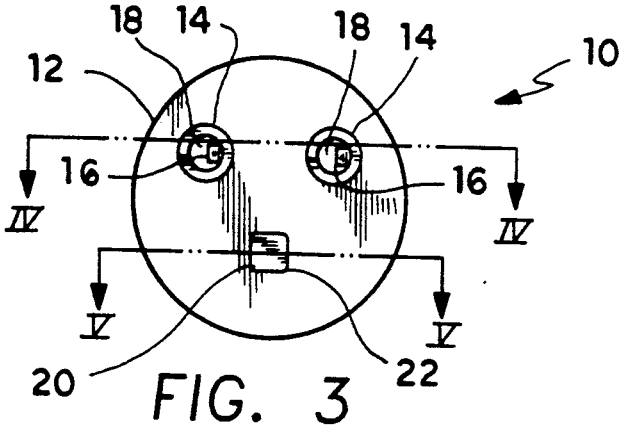
FIG. 3 is a front elevational view of the electrical plug.
Figure 4:
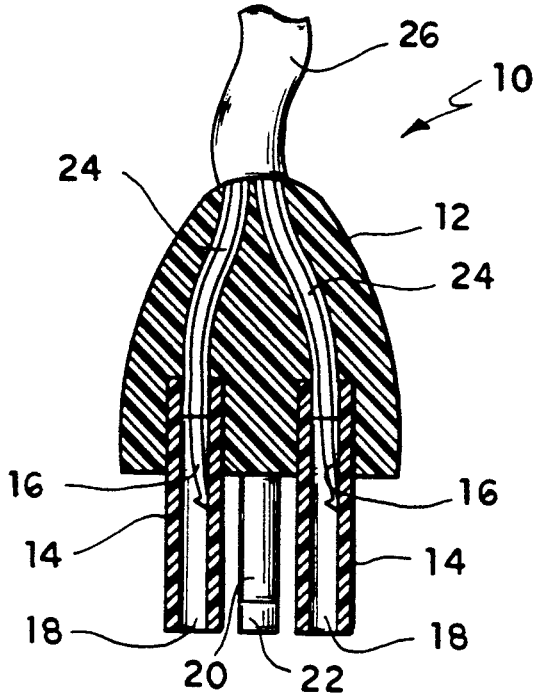
FIG. 4 is a cross-sectional view of the electrical plug drawn along the lines 4—4 of FIG. 3.
Figure 5:
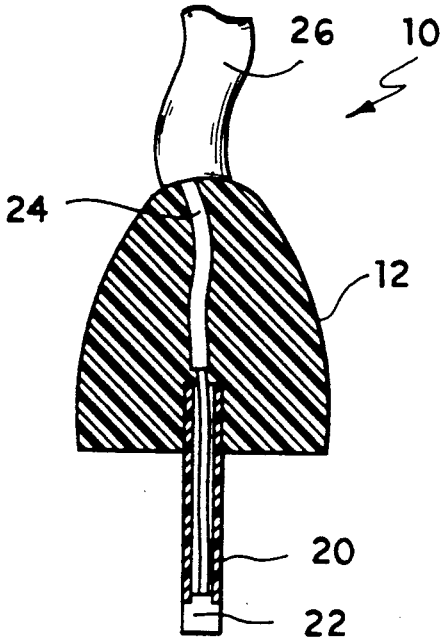
FIG. 5 is a cross-sectional view of the electrical plug drawn along the lines 5—5 of FIG. 3.
Figure 8:
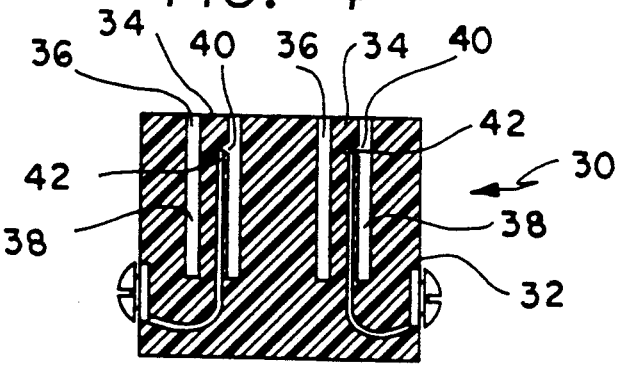
FIG. 8 is a cross-sectional view of the electrical receptacle plug drawn along the lines 8—8 of FIG. 7.
Figure 9:
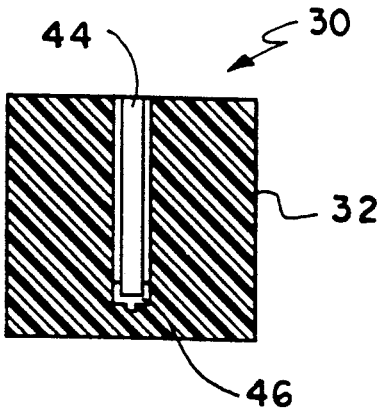
FIG. 9 is a cross-sectional view of the electrical receptacle drawn along the lines 9—9 of FIG. 7.
Figure 6:
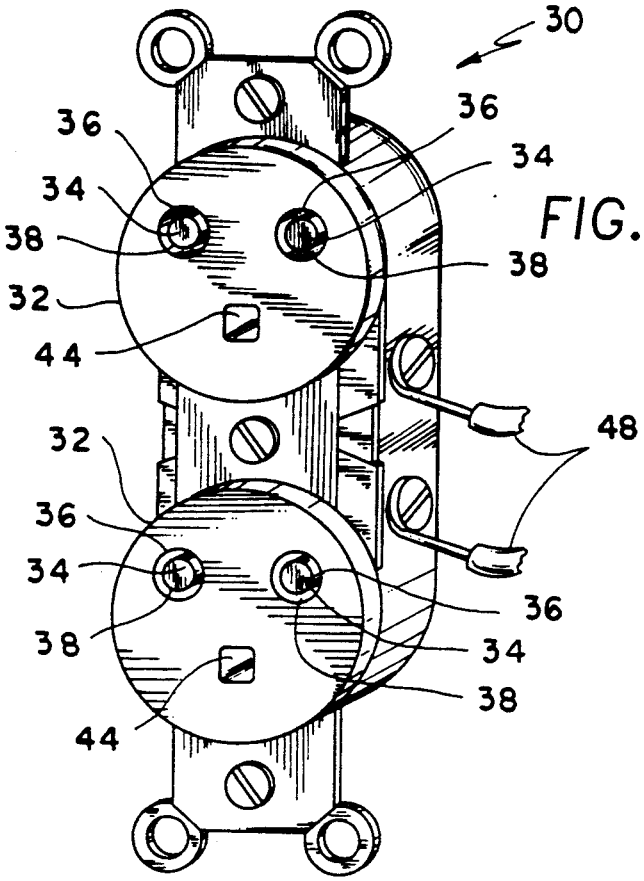
FIG. 6 is a perspective view of the electrical receptacle.
Figure 7:
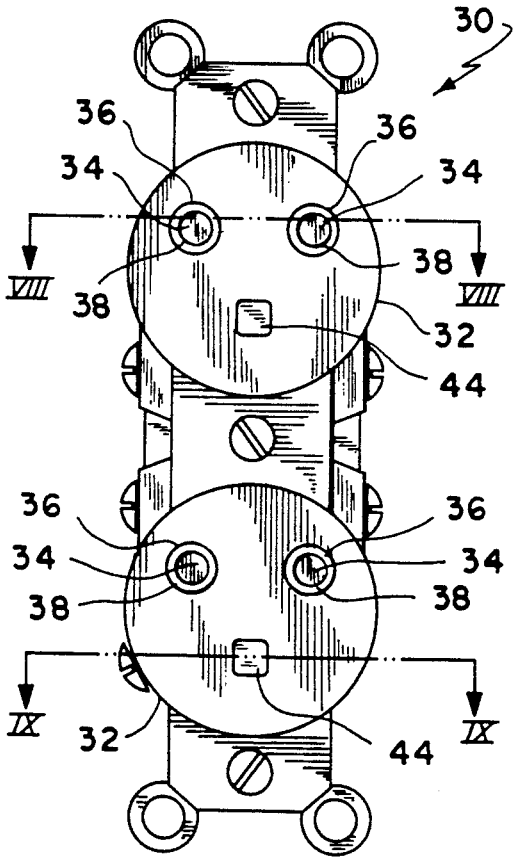
FIG. 7 is a front elevational view of the electrical receptacle.

The present invention, as shown in FIG. 1, is a mating electrical safety plug 10 and receptacle 30. The receptacle 30 is shown surface mounted within a wall 50 and partially covered with a conventional wall plate 70.

Referring to FIGS. 2-5, the plug 10 it comprised of a main body portion 12 having a set of non-conductive tubular prongs 14 projecting from a face thereof . Each prong facilitates as a shield to shroud a conductive element 16. The ends of the prongs 14 are each provided with an opening 18 to provide access to the conductive element 16. A non-conductive tubular ground prong 20 may be provided for plugs 10 which mate with ground receptacles 30. The end of the ground prong 20 is enclosed by a conductive tip 22. The conductive elements 16 and the conductive tip 22 are each joined to a respective conductor 24. The conductors 24 each originate from a multi-conductor cable or cord 26 which enters the through the rear end of the plug 10. The plug 10 may be molded in a conventional manner of a hard rubber material. Though the plug 10 is shown with a ground prong 20, the invention is not limited to applications of this type. That is, the plug 10 is not limited to the configuration shown, but may be configured without a ground prong 20 as well.

Now, referring to FIGS. 6-9, the receptacle 30 is shown in a duplex configuration. The receptacle 30 is not limited to this configuration but may be configured as a single receptacle, such as for use as a flush mount floor receptacle. The receptacle 30 is comprised of a main body portion 32 having a set of non-conductive central posts 34, each post 34 being concentrically disposed within an opening 36, thus forming an annular cavity 38 between the central post 34 and the inner peripheral walls which define the opening 36. Each central post 34 includes a recess 40 having a conductive element 42 disposed therein. Similar to the foregoing prongs, each central post 34 also facilitates as a shield to shroud a conductive element 42. The conductive element 42 within each central post 34 is only accessible through the respective recess 40. A ground opening 44 may be provided to accommodate plugs 10 with ground prongs 20. To the rear of the ground opening 44 is disposed a conductive ground element 46. The conductive elements 42 and the conductive ground elements 46 are each connected to the conductive wiring 48 of the electrical system. The conductive wiring 48 originates from a service panel (not shown) and distributes power throughout the electrical system. The receptacle 30 may be molded in a conventional manner of a ceramic material. Though the receptacle 30 is shown with a ground opening 44 and though the receptacle 30 is configured to be employed in single phase circuits, the invention is not limited to applications of this type. The receptacle 30 is not limited to the configuration shown, but may be configured to be employed in multi-phase circuits and may be configured without a ground opening 44 as well.

Figure 10:
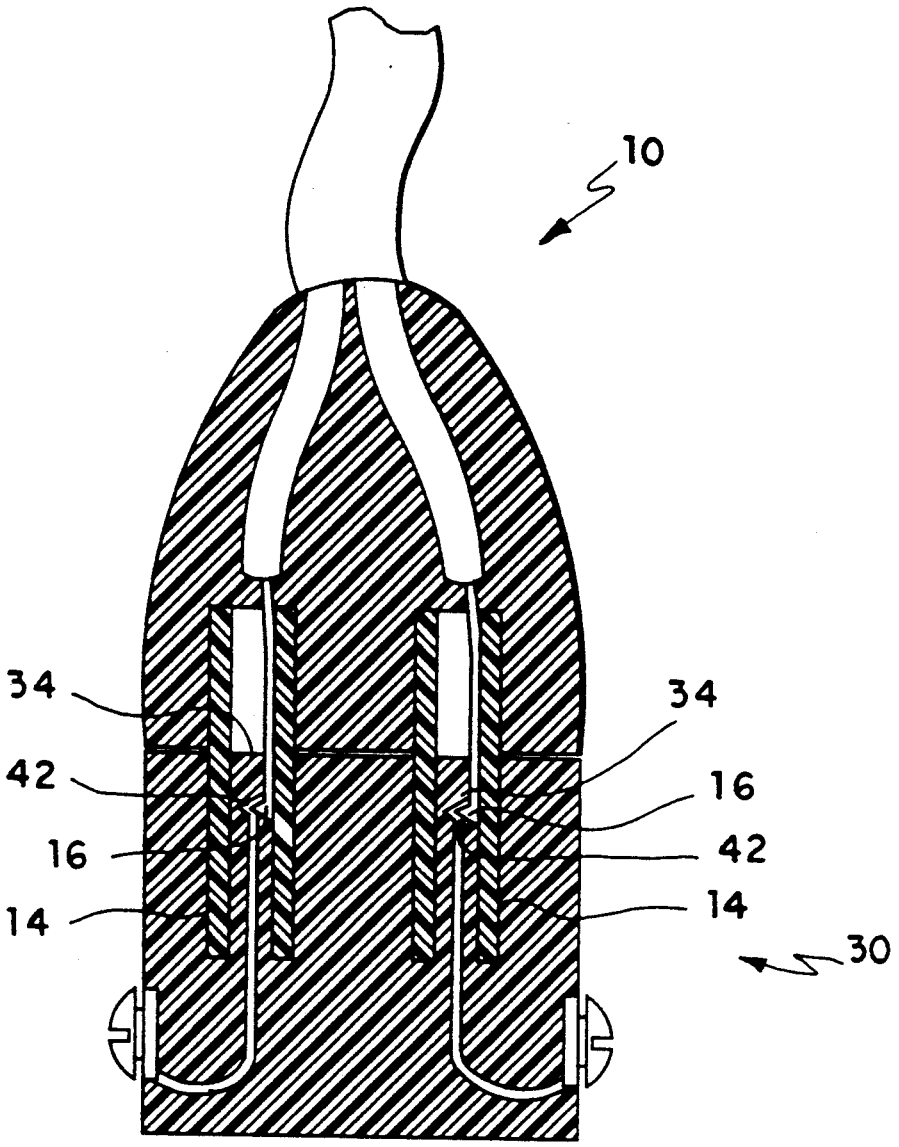
FIG. 10 is a detail view of the electrical receptacle.

FIG. 10 shows the plug 10 connected to the receptacle 30. The opening 18 (see FIGS. 2-4) in the end of each prong 14 provides a passage for a mating central post 34. Likewise, each annular cavity 38 (see FIGS. 6-8) is provided to receive a mating prong 14. Note, due to the orientation of the conductive elements 16,42, polarization is maintained constant for every appliance (not shown) throughout a circuit. When the plug 10 is fully connected to the receptacle 30, each conductive element 16 of the plug 10 enters a respective recess 40 of the receptacle 30 to engage with a corresponding conductive element 42 of the receptacle 30. Because of the shielding effect of each prong 14, the conductive elements 16 of the plug 10 are not exposed when the plug 10 is partially connected or disconnected from the receptacle 30. Moreover, by positioning the conductive elements 42 of the receptacle 30 within a recess 40, the conductive elements 42 of the receptacle are indirectly accessible as well. Thus, the risk of hazardous electrical shock is virtually eliminated.

It is to be understood that the present invention is not limited to the sole embodiment described above, but encompasses any and all embodiments within the scope of the following claims.

I claim:

1. A mating electrical safety plug and receptacle, said plug being attachable to an electrical appliance and said receptacle being connectable to an electrical system, said mating electrical safety plug and receptacle comprising:

a) a plug body having a set of non-conductive prongs extending therefrom, a conductive element being disposed within each of said prongs such that each said conductive element is partially exposed, and a set of conductors joining each said conductive element to a corresponding conductor within the electrical appliance;

b) a receptacle body having means defining a set of openings, means defining a recess disposed within each of said openings, a conductive element disposed within each said recess, and means to connect each said conductive element to a corresponding conductor of the electrical system, wherein said receptacle body further comprises an insulated central post concentrically disposed within each of said openings to provide an annular cavity defined between said insulated central post and an inner peripheral surface of each of said openings;

c) said plug body further including a ground prong which extends therefrom, whereby when said plug is connected to said receptacle, said conductive element of said plug engages a corresponding conductive element of said receptacle, said insulated central post is received interiorly of each of said prongs and each of said prongs is received interiorly of said annular cavity; and when said plug is partially disconnected, said conductive element of said plug are not engaged with said conductive elements of said receptacle and said conductive elements of said plug are not exposed; and when said plug is fully disconnected, said conductive elements within said receptacles are not directly accessible, thus reducing the risk of electrical shock.

2. The mating electrical safety plug and receptacle according to claim 1, wherein said prongs are disposed parallel relative to one another.

3. The mating electrical safety plug and receptacle according to claim 2, wherein said receptacle openings are disposed parallel relative to one another.

4. The mating electrical safety plug and receptacle according to claim 1, wherein said prongs extend transversely from said plug body.

5. The mating electrical safety plug and receptacle according to claim 1, wherein said prongs are tubular.

6. The mating electrical safety plug and receptacle according to claim 5, wherein each of said prongs is provided with an open end to provide access to said conductive element disposed therein.

7. The mating electrical safety plug and receptacle according to claim 6, wherein said openings in said receptacle are cylindrical.

8. The mating electrical safety plug and receptacle according to claim 5, wherein said conductive element disposed within each of said prong protrudes slightly from an inner surface of said prongs.

9. The mating electrical safety plug and receptacle according to claim 6, wherein said conductive element within each of said prongs protrudes interiorly of each of said prongs.

10. The mating electrical safety plug and receptacle according to claim 1, wherein said ground prong includes a non-conductive tubular member having a conductive tip and means to join said conductive tip to a corresponding conductor of the electrical system.

11. The mating electrical safety plug and receptacle according to claim 1, wherein said receptacle includes means defining a ground opening, said ground opening providing a passage for the receipt of said ground prong.

12. The mating electrical safety plug and receptacle according to claim 11, wherein said ground opening includes a conductive ground element being disposed therein.

13. The mating electrical safety plug and receptacle according to claim 12, further including means to join said conductive ground element to a corresponding conductor of the electrical system.

14. The mating electrical safety plug and receptacle according to claim 1, wherein said set of conductors joining each said conductive element to a corresponding conductor is paired and insulated to establish electrical continuity between the conductive element and the corresponding conductor.

* * * * *